United States Patent [19]

Ishii et al.

[11] 4,422,361

[45] Dec. 27, 1983

[54] ELECTRONIC MUSICAL INSTRUMENT

[75] Inventors: Hiroshi Ishii, Tachikawa; Hideaki Ishida, Hachioji, both of Japan

[73] Assignee: Casio Computer Co., Ltd., Tokyo, Japan

[21] Appl. No.: 274,529

[22] Filed: Jun. 17, 1981

[30] Foreign Application Priority Data

Jun. 20, 1980 [JP] Japan ..... 55-83582
Jun. 20, 1980 [JP] Japan ..... 55-83583
Jun. 20, 1980 [JP] Japan ..... 55-83585

[51] Int. Cl.[3] ..... G10H 3/06; G10B 15/00
[52] U.S. Cl. ..... 84/1.18; 84/483 R
[58] Field of Search ..... 434/311, 312; 250/566, 250/567, 568, 569; 84/1.18, 483 A

[56] References Cited

U.S. PATENT DOCUMENTS 3,889,568 6/1975 Amaya ..... 84/DIG. 12
4,261,241 4/1981 Gould et al. ..... 84/483 A

*Primary Examiner*—F. W. Isen
*Attorney, Agent, or Firm*—Frishauf, Holtz, Goodman & Woodward

[57] ABSTRACT

Bar codes representing sound information are printed on a marginal portion of a score. Prior to the performance, these bar codes are read out by a bar code reader, whereby chord data represented by these bar codes are successively stored in a memory provided in the body of a musical instrument. At the time of the performance, accompaniment sound corresponding to the stored chord data is automatically added to the melody performed by the player.

8 Claims, 14 Drawing Figures

FIG. 4
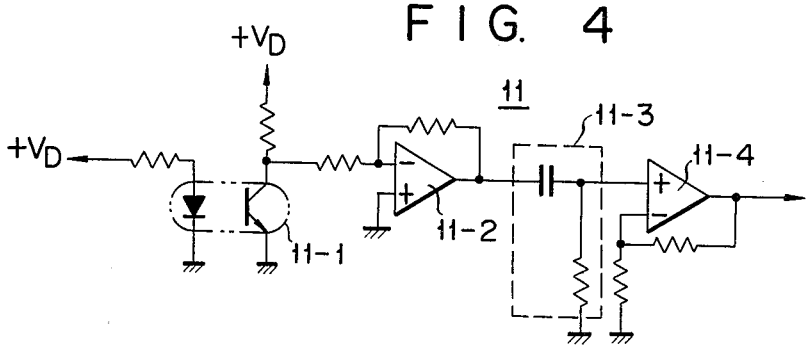
FIG. 5A
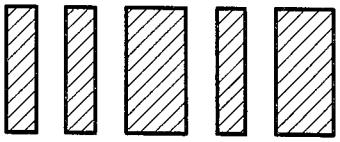
FIG. 5B
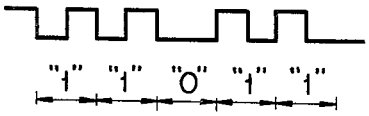
FIG. 6A
| CHORD CLASSI-FICATION | CODE |
|---|---|
| maj | 0 0 0 0 |
| min | 0 0 0 1 |
| 7 th | 0 0 1 0 |
| m 7 | 0 0 1 1 |
| dim | 0 1 0 0 |
| aug | 0 1 0 1 |
| 6 | 0 1 1 0 |
| m6 | 0 1 1 1 |
| 7~5 | 1 0 0 0 |
FIG. 6B
| CHORD CLASSI-FICATION | CODE |
|---|---|
| C | 0 0 0 0 |
| C# | 0 0 0 1 |
| D | 0 0 1 0 |
| D# | 0 0 1 1 |
| E | 0 1 0 0 |
| F | 0 1 0 1 |
| F# | 0 1 1 0 |
| G | 0 1 1 1 |
| G# | 1 0 0 0 |
| A | 1 0 0 1 |
| A# | 1 0 1 0 |
| B | 1 0 1 1 |
FIG. 6C
| KIND OF CODE | CODE |
|---|---|
| SEPARATOR | 1 1 0 1 |

| REGISTERED CODE NO. | CODE |
|---|---|
| 0 | 0 0 0 0 |
| 1 | 0 0 0 1 |
| 2 | 0 0 1 0 |
| 3 | 0 0 1 1 |
| 4 | 0 1 0 0 |
| 5 | 0 1 0 1 |
| 6 | 0 1 1 0 |
| 7 | 0 1 1 1 |
| 8 | 1 0 0 0 |
| 9 | 1 0 0 1 |
| 10 | 1 0 1 0 |
| 11 | 1 0 1 1 |

FIG. 8

| KIND OF CODE | CODE |
|---|---|
| START MARK | 1 1 1 1 1 1 1 1 |
| CONTROL CODE 1 | 1 1 0 0 |
| CONTROL CODE 2 | 1 1 0 1 |
| CHORD PROGRESS TERMINATION | 1 1 1 0 |
| DATA TERMINATION | 1 1 1 1 1 1 1 1 |
| LINE END MARK | 1 1 1 1 1 1 1 0 |

FIG. 9B

| 00000111 | 00011011 | 1101 | 1100 | 1111 | 11111110 |
|---|---|---|---|---|---|
| (6) | (7) | (8) | (9) | (10) | (11) |

| 0000 | 0000 | 0011 | 0000 | 0011 | 0000 | 0100 | 11111110 |
|---|---|---|---|---|---|---|---|
| (20) | (21) | (22) | (23) | (24) | (25) | (26) | (27) |

| 0001 | 0010 | 0000 | 0000 | 1110 | 11111111 | 10011110 |
|---|---|---|---|---|---|---|
| (36) | (37) | (38) | (39) | (40) | (41) | (42) |

ELECTRONIC MUSICAL INSTRUMENT

BACKGROUND OF THE INVENTION

This invention relates to electronic musical instruments in which bar codes printed on a score are read out prior to performance and the production of musical sound is controlled according to musical sound information represented by the read-out bar codes.

The score with which to play the usual electronic keyboard musical instrument such as an electronic organ is as shown in FIG. 1. In this score, the melody score for which the instrument is to be performed with the right hand and accompaniment chord names such as $E_m$, $B_7$, $A_m$ for performance with the left hand are provided. The player operates the keys for the melody and accompaniment chord with the respective right and left hands while looking at the score in performance.

However, since the melody and accompaniment performed respectively with the right and left hands have different rhythms, it is very difficult for beginners to perform both the melody and accompaniment. Accordingly, various methods for producing accompaniment sounds of the electronic organ automatically or semiautomatically have been contemplated, and some of them have been used in practice. In some of the prior art instruments the accompaniment sound information is stored on a magnetic tape, magnetic card, etc. However, these recording media are expensive, and also their capacity of storage is small so that only a limited quantity of information can be stored. In addition, since the tapes, cards, etc. are used independently of the score, they are liable to be lost to make the performance impossible.

An object of the invention, accordingly, is to provide an electronic musical instrument, with which the production of the musical sound can be controlled by using musical sound information recorded on a stable recording medium, which is inexpensive and has comparatively large capacity.

SUMMARY OF THE INVENTION

According to the invention, the above object is achieved by an electronic musical instrument, in which bar codes representing musical sound information printed on a score, for example, are read out with a bar code reader prior to the performance of the music, and accompaniment sound to the melody performed by the player is produced using the musical sound information represented by the read-out bar codes.

This invention can be more fully understood from the following detailed description when taken in conjunction with the accompanying drawings.

BRIEF DESCRIPTION OF THE DRAWINGS

FIG. 4 is a circuit diagram showing an example of the bar code reader section in the circuit of FIG. 3;

FIGS. 5A and 5B are views showing an example of the bar code and the waveform of an output obtained when the bar codes are read out;

FIGS. 6A to 6C, 7 and 8 are views showing various binary codes used with the embodiment of FIG. 3;

FIGS. 9A and 9B show a view representing a score expressed using the codes shown in FIGS. 6A to 6C, 7 and 8.

DETAILED DESCRIPTION

Figure 2:
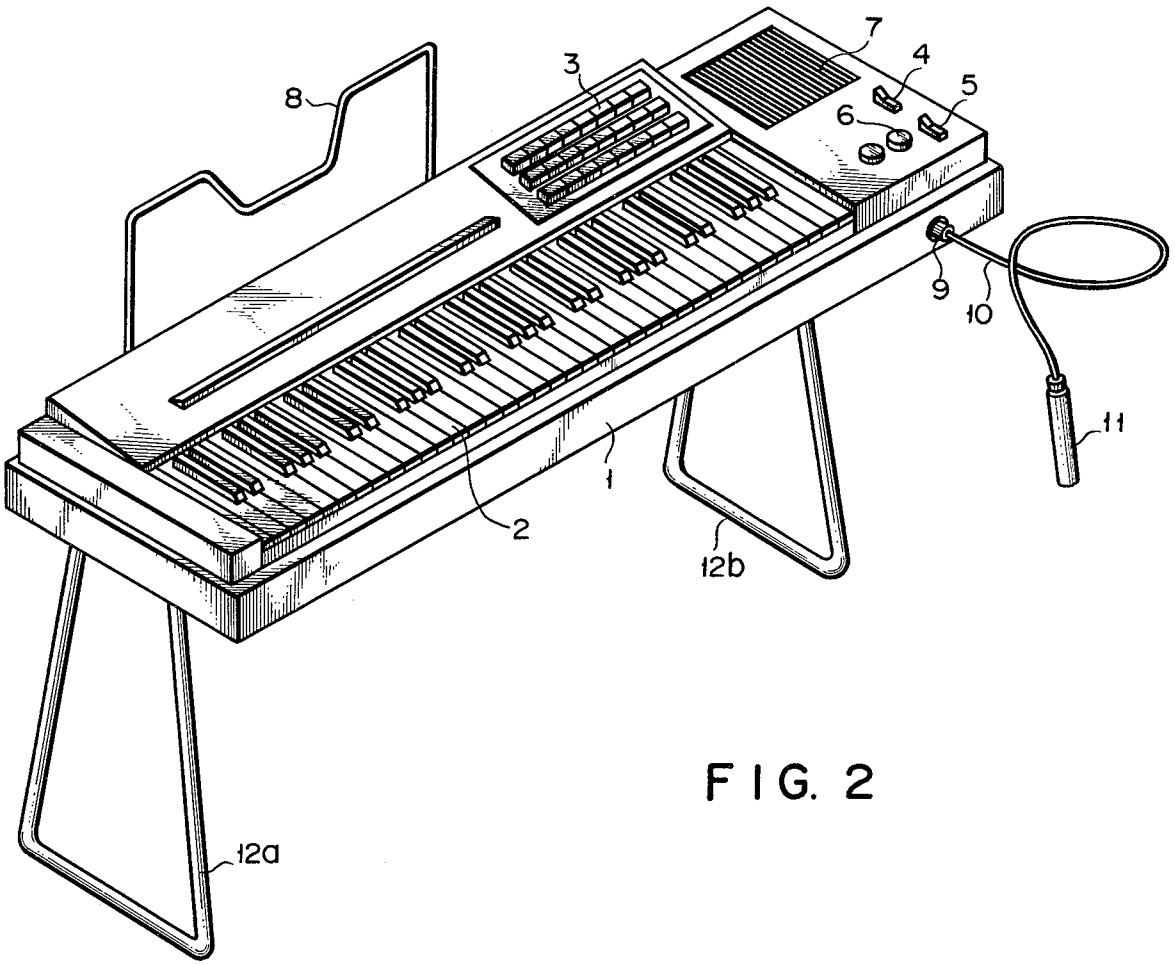
FIG. 2 is a perspective view showing an embodiment of the electronic organ according to the invention.
Figure 10:
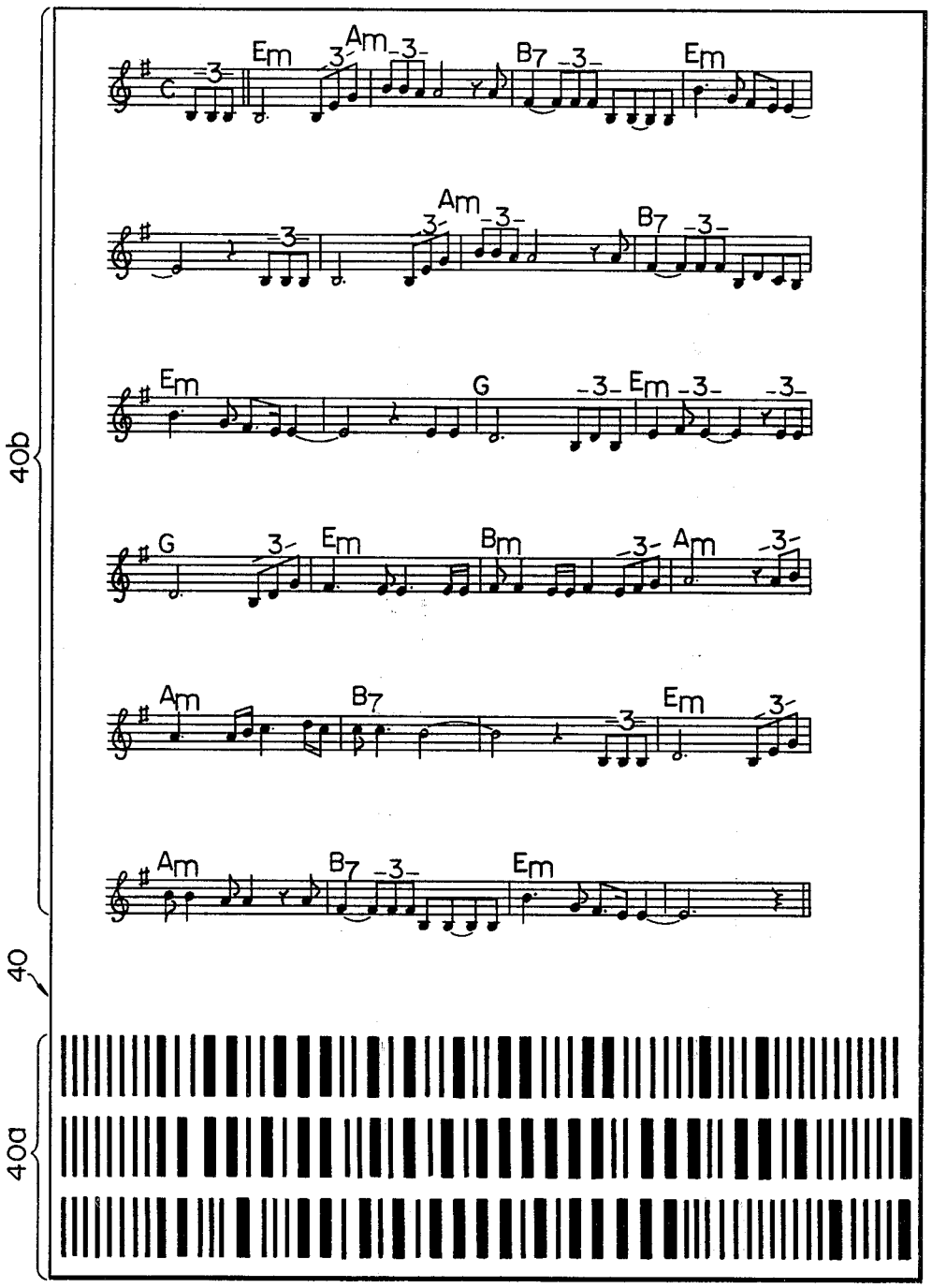
FIG. 10 shows an example of the score used in accordance with the invention.

Now, an embodiment of the invention will be described in detail with reference to the accompanying drawings. Referring now to FIG. 2, there is shown an electronic organ, whose body 1 is provided with a keyboard 2, a group of setting switches 3, a power source switch 4, a bar code reader switch 5, a volume switch 6, a loudspeaker 7 and a music stand 8. The front of the instrument body 1 is provided with a connector 9, to which a bar code reader 11 is connected via a lead 10. The switches 3 are provided for setting tone colors which are determined by the waveforms and envelopes of musical tones and also various rhythms. The bar code reader switch 5 is operated when reading out codes printed on a score as shown in FIG. 10 by operating the bar code reader 11. The body 1 is supported, if necessary, by a pair of support legs 12*a* and 12*b*.

Figure 3:
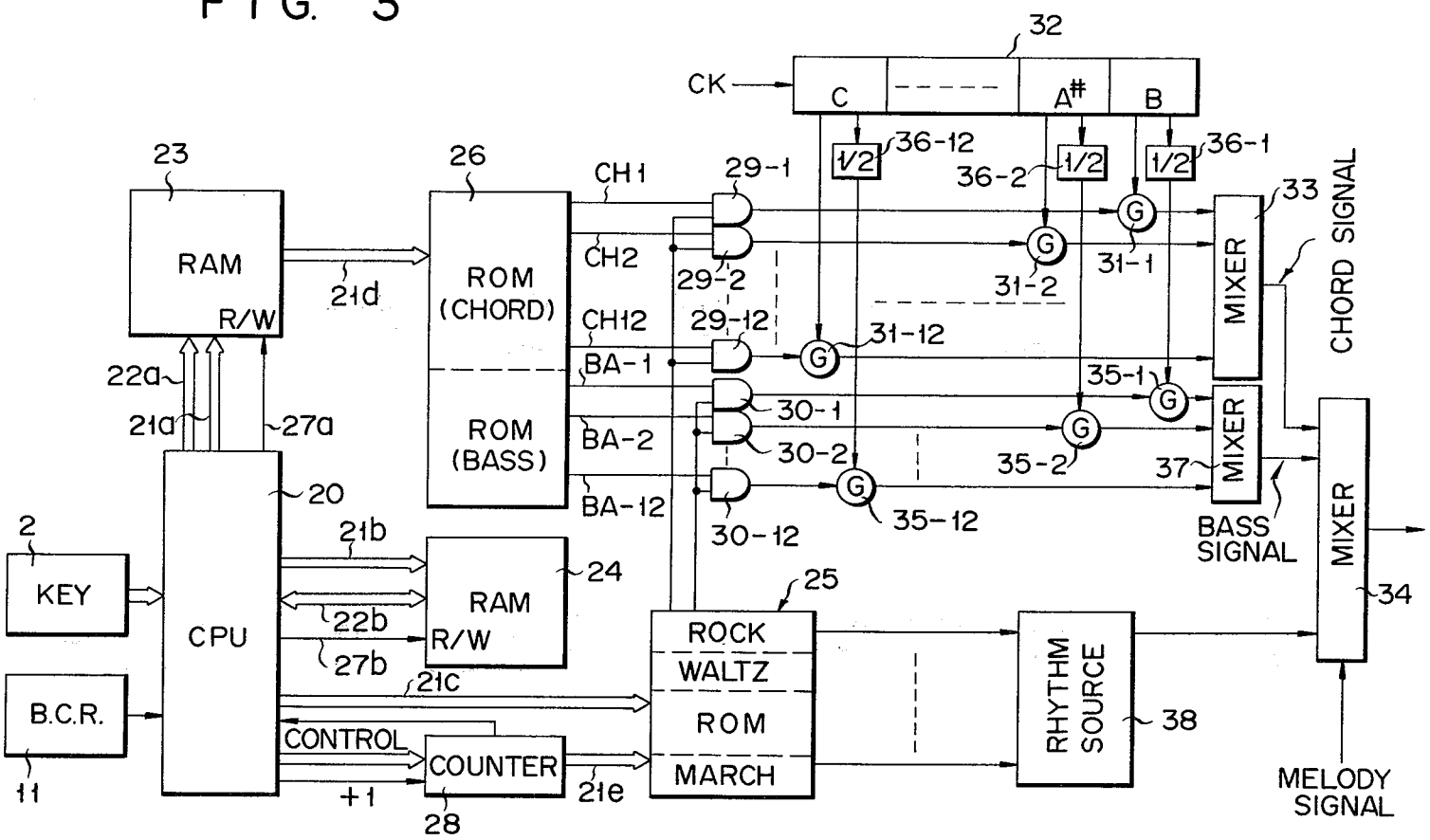
FIG. 3 is a block diagram showing the circuit of the electronic organ shown in FIG. 2.

FIG. 3 shows the circuit of the electronic organ having the appearance as described. The key operation output of the keyboard 2 and the read-out output of the bar code reader 11 are coupled to a central processing unit (CPU) 20. The CPU 20 is coupled through address lines 21*a* and 21*b* and data lines 22*a* and 22*b* to random access memories (RAM) 23 and 24, and also through an address line 21*c* to a read only memory (ROM) 25. The RAM 23 is coupled through an address line 21*d* to a ROM 26. From the CPU 20, read/write instruction signals are supplied through lines 27*a* and 27*b* to R/W terminals of the RAMs 23 and 24. The ROM 26 includes a memory area where chord data is stored and a memory area where bass sound data is stored. In the RAM 23 a code table of chord data is stored, and these chord data is read out and supplied through the line 21*d* to the ROM 26. In the RAM 24, sequential chord data is stored. From the CPU 20 "+1" signals are supplied to a counter 28 for counting therein. The operation of the counter 28 is controlled by a control signal from the CPU 20. The content of the counter 18 is supplied as a lower address signal to the ROM 25 while an upper address signal is supplied from the CPU 20 through a line 21*c* to the ROM 25. As is shown, the ROM 25 has memory areas for different rhythms such as rock, waltz, march, etc., and these areas are specified by the upper address signal which is supplied from the CPU 20 through the line 21*c*. In each area which is specified by the upper address signal, step data representing a rhythm pattern is stored. This step data has a particular code such as, for instance, "1, 0, 1, 0, 1, 0, 1, 0". Here, "1" represents sound production, and "0" a pause. In other words, this code means that predetermined sounds are produced four times at a constant interval. Such a step data in each area is addressed by the lower address output of the counter 28. The rate of counting of the counter 28 is determined by the rate at which "1" signals are supplied from the CPU 20. A control signal for specifying the number of scales of the counter 28 and setting the operation cycle to a one-half bar or one bar is provided from the CPU 20. Pulses for shifting the address of the RAM 24 are supplied from the counter 28 to the CPU 20.

The ROM 26 supplies 12 chord outputs CH1 to CH12 and 12 bass outputs BA1 to BA12 to each one input terminal of AND gates 29-1 to 29-12 and 30-1 to 30-12. Rhythm pattern signals for the corresponding chords are supplied from the ROM 25 to the other input terminals of the AND gates 29-1 to 29-12. Thus, predetermined chord data is provided from the AND gates 29-1 to 29-12 with a predetermined rhythm and coupled to gate input terminals of gates 31-1 to 31-12. To the input terminals of the gates 31-1 to 31-12 are supplied 12 different note signals such as for B, A♯, . . . C from an oscillator 32. As some of the gates 31-1 to 31-12 are enabled by outputs from corresponding ones of the AND gates 29-1 to 29-12, predetermined note signals are passed through the enabled AND gates to be supplied to a mixer 33. As a result, a corresponding chord signal is supplied from the mixer 33 to a next stage mixer 34.

Meanwhile, rhythm pattern signals for the bass are supplied from the ROM 25 to the other input terminals of the AND gates 30-1 to 30-12. Thus, predetermined bass data is supplied from the AND gates 30-1 to 30-12 with a predetermined rhythm and supplied to the gate input terminals of the gates 35-1 to 35-12. To the input terminals of the gates 35-1 to 35-12 are supplied 12 different note signals at one half the output frequency of the oscillator 32 through respective frequency dividers 36-1 to 36-12. The note signals thus obtained and lowered for one octave from the gates 35-1 to 35-12 are supplied to the mixer 37, and bass signals from the mixer 37 are supplied to the next stage mixer 34.

Further, other rhythm pattern data is supplied from the ROM 25 to a rhythm source 38. This rhythm source 38 provides percussion instrument sounds as rhythmic sounds, and according to the rhythm pattern data mentioned above a predetermined rhythm signal is provided from the source 38 and supplied to the mixer 34. The chord signal, bass signal and rhythm signal thus obtained are mixed in the mixer 34 with the melody signal, and the resultant signal is coupled through an amplifier (not shown) to a loudspeaker 7 shown in FIG. 2 to produce the corresponding sound. The melody signal is obtained by operating the keyboard 2.

FIG. 4 shows the construction of a bar code reader 11. It includes a photo-reflector 11-1, which is provided at the tip and has a light emitting element and a light receiving element for providing an electric signal of different current amplitudes corresponding to different light reflectivities of the printed bar code. The output of the photo-reflector 11-1 is amplified by an amplifier 11-2, the output of which is supplied to a differentiating circuit 11-3. The differential output of the differentiating circuit 11-3 is supplied to an operational amplifier 11-4, which is a bi-stable circuit and produces a corresponding binary logic signal.

When a bar code as shown in FIG. 5A, which is an FM coded bar code, is scanned by the bar code reader 11 of the above construction, the operational amplifier 11-4 provides an output having a waveform as shown in FIG. 5B. Here, a logic value "1" is provided if a change between high and low levels is occurred during one bit section, and otherwise a logic value "0" is provided.

Now, a score which can be used for the electronic organ of the above construction will be described by referring to the score of FIG. 1 having bar codes as shown therein.

Figure 1:
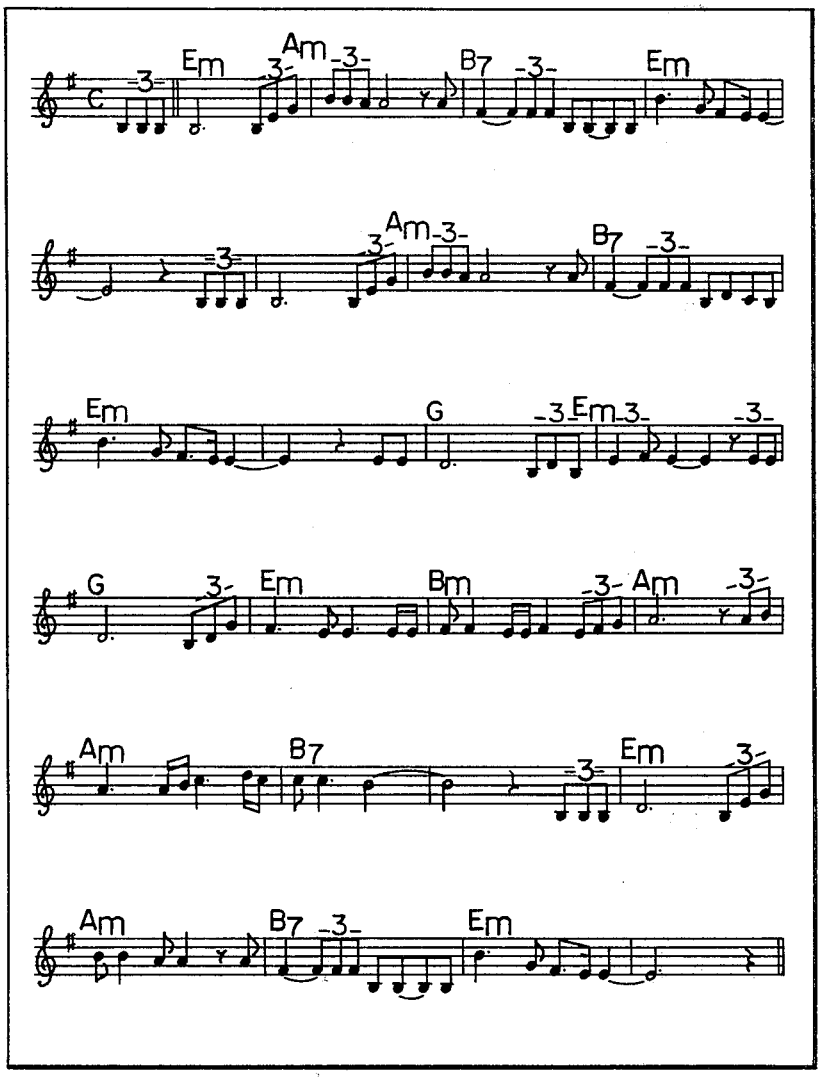
FIG. 1 shows a score for the performance of an electronic organ.

The score of FIG. 1 has chords sequentially arranged in the order of:

$E_m$, $A_m$, $B_7$, $E_m$, $E_m$, $E_m$, $A_m$, $B_7$, $E_m$, $E_m$, G, $E_m$, G, $E_m$, $B_m$, $A_m$, $A_m$, $B_7$, $B_7$, $E_m$, $A_m$, $B_7$, $E_m$ and $E_m$.

These chords are converted to code data as shown in FIGS. 6A and 6B. For example, the first chord "$E_m$" in the chord series is a minor chord with the root "E", and the corresponding code is thus "00010100". Likewise, the next chord "$A_m$" is converted to a code "00011001".

In the score of FIG. 1, there are five different chords, namely chords "$E_m$", "$A_m$", "$B_7$", "G" and "$B_m$". If these five different chords are given respective registered code numbers "0" to "4" which respectively correspond to codes "0000" to "0100" as shown in FIG. 7 so that these registered code numbers "0" to "4" may be used to specify code table, the aforementioned chord series notation may be expressed as 0, 1, 2, 0, 0, 0, 1, 2, 0, 0, 3, 0, 3, 0, 4, 1, 1, 2, 2, 0, 1, 2, 0, 0.

Figures 7, 9A:
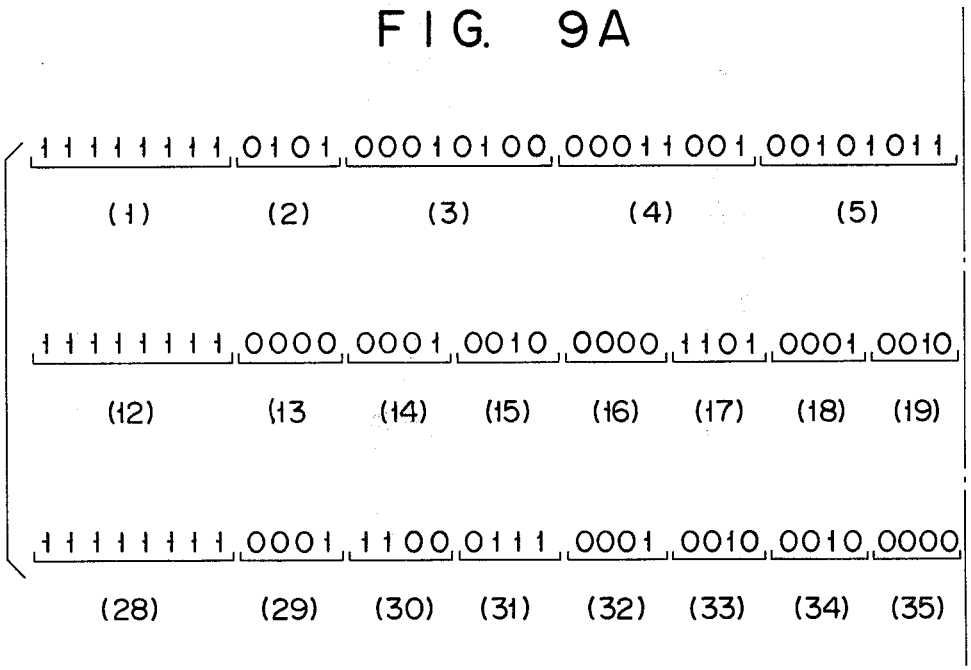

FIGS. 9A and 9B show binary data for the aforementioned chord series that is obtained on the basis of the above method. More particularly, these three rows of data shown in FIGS. 9A and 9B correspond to respective three lines of bar codes (not shown). The areas (1), (12) and (28) in FIGS. 9A and 9B each represents a start mark for each row (see FIG. 8). The area (2) specifies the kind of the rhythm. In the instant example, a code "0101" specifying the slow rock is specified. The table relating different kinds of rhythms and corresponding codes is not shown. The areas (3) to (7) are code table areas, in which the corresponding codes for the chords "$E_m$", "$A_m$", "$B_7$", "G" and "$B_m$" are set.

The area (8) represents a separator as shown in FIG. 6C, which separates the code table areas and table reference areas where the actual progression of chords are stored. In the areas (9) and (10) following the area (8), data for the control code 1 as shown in FIG. 8 and for a numerical value "16" are set. The control code 1 represents that the chords of the steps as a result of adding "+1" to the number shown by the next 4-bit data each correspond to one bar; in the instant example, it represents that the next 16 chord names each correspond to the length of one bar. Basically, the length for a one-half bar is specified by one chord name.

The next are (11) and the area (27) in the second line each represent a line end mark as shown in FIG. 8.

In the areas from the area (13) in the second line through the area (39) in the third line, data for the chords in the aforementioned chord series are set. More particularly, in the area (13), a code "0000" representing the chord "$E_m$" is set, and likewise the codes for the chords "$A_m$", "$B_7$", "$E_m$" are set in the following areas. In the area (17), a control code 2 (see FIG. 8) is set which indicates that the following two codes are the same as the preceding registered code, that is, indicating that the chord "$E_m$" set in the area (16) will further appear in the following two bars. The codes in the areas (30) and (31), like those in the areas (9) and (10), indicate that the next 8 chord names each correspond to the length of one bar.

The areas (40) and (41) each represent a mark of the chord progression termination and a mark of the data termination as shown in FIG. 8. The area (42) following the area (41) is a parity check area, in which 16-bit data for CRC (Cyclic Redundancy Check) is set.

The binary code information obtained in the above way, is converted by FM coding as shown in FIG. 5 into bar code data as shown in the lower part **40*a* of the score 40 shown in FIG. 10**. The individual lines in FIGS. 9A and 9B coincide with those in FIG. 10, and the upper part 40*b* in the score 40 of FIG. 10 is the same as the score of FIG. 1.

Now, the operation of the embodiment having the construction described above will be described. For producing automatic accompaniment in the performance of the piece shown in the score 40 with the electronic organ of this embodiment, the bar code reader switch 5 is turned on to render the bar code reader 11 operative, and the lower part 40*a* of the score 40 is scanned with the bar code reader 11. As this operation is executed for the successive lines in the lower part 40*a* of the score 40, the read-out data is supplied from the bar code reader 11 to the CPU 20.

In the circuit of FIG. 3, the code table data is stored in the RAM 23 while the chord series data is stored in the RAM 24. In other words, the data in the areas (3) through (7) in FIGS. 9A and 9B is set in the RAM 23, while the data in the areas (9), (10), (13) through (26), and (29) through (40) is set in the RAM 24. The distribution of data between the RAMs 23 and 24 is effected through the detection of the separator mark in the area (8) in FIG. 9B by the CPU 20.

When the rhythm start switch is operated, for instance after performing the melody in the first bar of the score 40*b* of FIG. 10, the CPU 20 instructs the accompaniment sound source circuit or ROM 25 to perform the chord "$E_m$" specified by the area (13) shown in FIG. 9A with the rhythm specified by the area (2), i.e., the slow rock rhythm. Thus, the specified rhythm sound signal (i.e., percussion sound) is produced at the rhythm source 38 and supplied to the mixer 34 under the control of the ROM 25. Chord and bass sound signals are also supplied to the mixer 34 through the mixers 33 and 37. While a melody sound signal produced by operating the keyboard 2 is supplied from a main sound source circuit (not shown) to the mixer 34. Thus, the signals from the accompaniment sound source circuit and main sound source circuit are mixed together to produce a resultant signal, which is coupled through the amplifier to the loudspeaker 7 for producing the corresponding music sound.

At the time of the performance, as the data for the first chord "$E_m$38 ("0000" in this case) is read out from the RAM 24 and supplied to the CPU 20, a corresponding area ("0000") in the RAM 23 is specified by the supplied data. The chord data ("00010100" in this case) read out from the RAM 23 is also supplied to the ROM 26. When the data for the chord "$E_m$" is supplied from the RAM 23 to the ROM 26, the ROM 26 supplies the output corresponding to this chord "$E_m$" selectively to the AND gates 29-1 to 29-12. Also, a signal specifying the bass sound is provided from the bass area of the ROM 26 and selectively supplied to the AND gates 30-1 to 30-12.

In the above way, the CPU 20 progressively reads out the content of the RAM 24 and supplies it to the RAM 23 for the successive chords. At this time, when a control code is read out, the shift of address of the RAM 23 is inhibited for two bars. More particularly, the shift of address in the RAM 24 is inhibited so as not to alter the data supplied to the RAM 24 until two subsequent address shift clock pulses are provided from the counter 28.

Likewise, the accompaniment sound signal for the following chords "$A_m$", "$B_7$", "$E_m$", and rhythm sound and bass sound signals are provided from the RAM 24 and mixed with melody sound signals provided with the operation of the keyboard for producing the corresponding sounds. When the rhythm accompaniment for the last bar of the score 40 is ended, the circuit of FIG. 3 is rendered into the waiting state to stop the production of musical sound.

While in the above embodiment various rhythms and chord series are printed as bar code information for providing rhythm accompaniment on the basis of that information, it is also possible to further record various other musical sound data such as tone color information of the musical sound to be produced (i.e., information about the waveform and envelope of the musical sound and also about the characteristics of filters) or information about musical effects. In electronic organs or musical synthesizers, a great number of manually operable switches are provided, so that it is almost impossible to instantly specify desired tone color or musical effect. If the afore-mentioned data is printed in the form of bar codes on the score, given instructions can be instantly specified.

While in the above embodiment chord data have been printed on the score for the successive chords, it is also possible to further print bar codes representing the pitch and interval of successive accompaniment sounds so that these accompaniment sounds may be produced simultaneously with the corresponding melody sound produced through manual operation of the keyboard 2.

Further, while in the above embodiment the bar codes have been produced by FM coding, they may also be produced by various other coding methods such as RZ, NRZ, NRZI, PE and MFM coding.

Further, in the above embodiment the bar code reader 11 is removably connected to the connector 9 of the instrument body 1 via the lead 10, that is, it may be installed only when it is used. This is very convenient for performance or storage of the instrument.

Various other changes and modifications of the embodiment are also possible without departing from the scope and spirit of the invention.

As has been described in the foregoing, with the electronic musical instrument according to the invention, which is provided with a bar code reader for reading out a medium provided with bar codes of predetermined musical sound information, the musical sound information can be set very easily and in a short period of time, and the operation control property can be improved. In addition, since the medium on which to provide the bar codes may be ordinary paper sheet, a great cost reduction can be obtained compared to the cases of using magnetic cards, magnetic tapes or semiconductor memories, which is very beneficial.

What we claim is:

1. A bar code recording and reproducing system comprising:

a medium on which is recorded bar code information which includes at least code table areas containing a plurality of code data, table reference areas containing a plurality of symbol data corresponding to respective ones of said code data arranged in a given sequence, and separator areas containing separator information and separating said code table areas from said table reference areas;

a bar code reader for reading said bar code information recorded on said medium;

discriminating means coupled to said bar code reader for discriminating code data information of said code table areas and symbol data information of said table reference areas by detecting separator information of said separator areas among the information read out by said bar code reader; and converting means coupled to said discriminating means and responsive to said information read out by said bar code reader for converting said plurality of symbol data read out from said table reference areas into a corresponding plurality of code data arranged in said given sequence according to the result of discrimination performed by said discriminating means.

2. The bar code recording and reproducing system of claim 1, wherein said code data represents selected chord information for producing accompaniment sound in an electronic musical instrument.

3. The bar code recording and reproducing system of claim 1 or 2, wherein said medium comprises at least one paper sheet on which said bar code information is printed.

4. The bar code recording and reproducing system of claim 1, wherein each of said code data comprises a plurality of data elements, and wherein each of said symbol data comprises a smaller plurality of data elements.

5. A bar code recording and reproducing system for an electronic musical instrument having sound producing means, comprising:

a medium on which is recorded musical information in the form of bar code information which includes at least code table areas containing a plurality of musical code data, table reference areas containing a plurality of symbol data corresponding to respective ones of said musical code data arranged in a given sequence and separator areas containing separator information and separating said code table areas from said table reference areas;

a bar code reader for reading said bar code information recorded on said medium;

discriminating means coupled to said bar code reader for discriminating musical code data information of said code table areas and symbol data information of said table reference areas by detecting separator information of said separator areas among the information read out by said bar code reader; and converting means coupled to said discriminating means and responsive to said information read out by said bar code reader for converting said plurality of symbol data read out from said table reference areas into a corresponding plurality of said musical code data arranged in said given sequence according to the result of discrimination performed by said discriminating means;

said sound producing means coupled to said converting means producing musical sounds in accordance with the converted sequence of said plurality of musical code data.

6. The bar code recording and reproducing system for an electronic musical instrument of claim 5, wherein said musical code data represents selected musical chord information for producing accompaniment sound in the electronic musical instrument.

7. The bar code recording and reproducing system for an electronic musical instrument of claim 5 or 6, wherein said medium comprises at least one paper sheet on which said bar code information is printed.

8. The bar code recording and reproducing system for an electronic musical instrument having sound producing means of claim 5, wherein each of said musical code data comprises a plurality of data elements, and wherein each of said symbol data comprises a smaller plurality of information elements.

* * * * *